US011731816B1

(12) United States Patent
Mason et al.

(10) Patent No.: US 11,731,816 B1
(45) Date of Patent: Aug. 22, 2023

(54) HYBRID FOOD CONTAINER LIDS CONVERTIBLE INTO CUTLERY

(71) Applicant: Hearthwood, LLC, Mystic, CT (US)

(72) Inventors: Thomas Mason, Mystic, CT (US); Hunter Mason, Mystic, CT (US); Seth Mason, Mystic, CT (US)

( * ) Notice: Subject to any disclaimer, the term of this patent is extended or adjusted under 35 U.S.C. 154(b) by 0 days.

(21) Appl. No.: 17/072,747

(22) Filed: Oct. 16, 2020

(51) Int. Cl.
*B65D 51/24* (2006.01)
*A47G 21/04* (2006.01)
*A47G 21/00* (2006.01)

(52) U.S. Cl.
CPC ..... *B65D 51/246* (2013.01); *A47G 21/04* (2013.01); *B65D 51/247* (2013.01); *A47G 2021/002* (2013.01)

(58) Field of Classification Search
CPC .... B65D 51/246; B65D 51/247; A47G 21/04; A47G 2021/002
See application file for complete search history.

(56) References Cited

U.S. PATENT DOCUMENTS

| | | | | |
|---|---|---|---|---|
| 4,218,010 | A * | 8/1980 | Ruff | A47G 21/04 30/328 |
| 5,992,667 | A * | 11/1999 | Huang | A47G 21/02 206/541 |
| D571,162 | S * | 6/2008 | Fite, IV | D7/642 |
| 7,637,417 | B2 * | 12/2009 | Fite, IV | A47J 43/281 229/4.5 |
| 10,946,607 | B2 * | 3/2021 | Lee | B31D 5/04 |
| 11,134,802 | B2 * | 10/2021 | Goldberg | B65D 77/245 |
| 11,225,364 | B2 * | 1/2022 | Goldberg | A47J 43/288 |

* cited by examiner

*Primary Examiner* — John K Fristoe, Jr.
*Assistant Examiner* — Jennifer Castriotta
(74) *Attorney, Agent, or Firm* — Steven Rinehart

(57) ABSTRACT

Hybrid food container lids convertible into cutlery may include a scoop section and a handle section. The scoop section may be defined by an outer edge of the lid or a tear strip formed in the lid. The handle may fold against the scoop as the lid is attached to a container. The handle may include a first guiding line that defines a first fold of the handle. The first fold may bring the sides of the handle together. Another guiding line may define a second fold of the handle that causes the scoop to become flat or concave when the handle is also folded along the first guiding line. The scoop section and the handle section may together form a piece of cutlery such as a spoon, a fork, a spork, and so forth. The cutlery and/or other portions of the hybrid lid may be disposable.

18 Claims, 8 Drawing Sheets

HYBRID FOOD CONTAINER LIDS CONVERTIBLE INTO CUTLERY

BACKGROUND

Many types of food are served in containers. This may be for practical reasons, such as regarding foods that are difficult to consume without a container (e.g. soup, yogurt, cereal, and so forth). Foods may be packaged in containers as a way of delivering food from a producer and/or manufacturer to a retailer and/or consumer. In some cases, food is packaged in disposable and/or single-serving containers. The consumers may consume the packaged food directly from the container. The consumers may dispose of the container after the food has been consumed.

BRIEF DESCRIPTION OF THE DRAWINGS

The present description will be understood more fully when viewed in conjunction with the accompanying drawings of various examples of hybrid food container lids convertible into cutlery. The description is not meant to limit the hybrid food container lids convertible into cutlery to the specific examples. Rather, the specific examples depicted and described are provided for explanation and understanding of hybrid food container lids convertible into cutlery. Throughout the description the drawings may be referred to as drawings, figures, and/or FIGS.]

DETAILED DESCRIPTION

Figure 1:
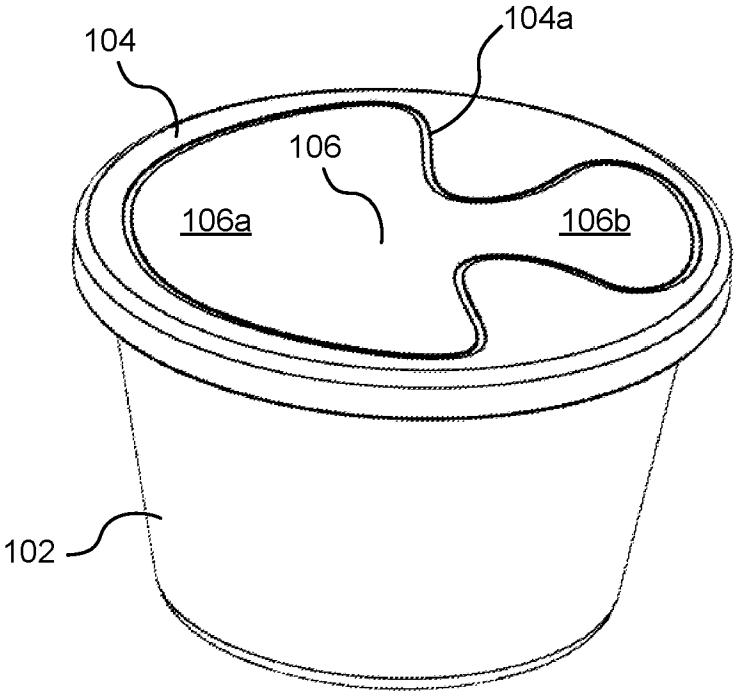
FIG. 1 illustrates a food container with a hybrid lid that is convertible into cutlery, according to an embodiment.

Hybrid food container lids convertible into cutlery as disclosed herein will become better understood through a review of the following detailed description in conjunction with the figures. The detailed description and figures provide merely examples of the various embodiments of hybrid food container lids convertible into cutlery. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional food container may include a dish and a lid for the dish. The dish and/or the lid may be disposable. The conventional container may not include cutlery for consuming the food. Thus, a consumer may have to obtain cutlery from another source. In some cases, cutlery may be separately attached to the food container, such as being taped to an outside of the container. However, cutlery that is attached to the food container, especially cutlery attached to the outside of the food container, is susceptible to being inadvertently stripped from the container. Cutlery attached to the outside of the food container may also be susceptible to contamination making the cutlery unsanitary. This may occur during or after packaging of food in the food container, during delivery of the food and food container to a retail environment, and/or after the food and food container has been purchased by a consumer. In such cases, the consumer again has to resort to finding cutlery at other sources. This can be particularly problematic when other sources are not readily available, such as for individuals working outside an office, children on field trips, and/or other people who eat while on the go.

One solution many consumers resort to is using non-disposable cutlery (e.g. silverware from home) to consume food out of disposable packaging. This carries the risk, and indeed the in many cases the actual result, of losing silverware. Consumers then have to replace their silverware, increasing their own cost of consuming food from disposable packaging. Consumers may opt to consume food from the container without cutlery. This may lead to spills and/or cause the consumer to not consume all the food in the container. In turn, this may lead to food waste.

Implementations of hybrid food container lids convertible into cutlery may address some or all of the problems described above. Hybrid food container lids convertible into cutlery may include a scoop section and a handle section. The scoop section may be defined by an outer edge of the lid or a tear strip formed in the lid. The handle may be folded against the scoop as the lid is attached to a container. The handle may include a first guiding line that defines a first fold of the handle. The first fold may bring a first side of the handle and a second side of the handle together. Another guiding line may define a second fold of the handle that causes the scoop to become flat or concave when the handle is also folded along the first guiding line. The scoop section and the handle section may together form a piece of cutlery such as a spoon, a fork, a spork, and so forth. The cutlery and/or other portions of the hybrid lid may be disposable.

The hybrid lid-cutlery may reduce and/or eliminate the need for additional, separate cutlery with packaged foods. The hybrid lid-cutlery may thereby reduce waste. The waste associated with previous packaged foods may have included a container, a lid, and a piece of cutlery. However, the hybrid lid-cutlery, including disposable hybrid lid-cutlery, may reduce the overall waste by enabling the lid to be repurposed. In some cases, the waste due to the consumption of disposable food packaging may be reduced in a range from ten percent to thirty percent. Additionally, the hybrid lid-cutlery may put consumers' minds at ease by taking away the worry that the consumer will forget to bring cutlery with the packaged food. This may entice consumers to purchase packaged food with the hybrid lid-cutlery.

FIG. 1 illustrates a food container 102 with a hybrid lid 104 that is convertible into cutlery 106, according to an embodiment. The hybridization of the lid 104 and the cutlery 106 may entice consumers to purchase packaged food with the hybrid lid 104 and cutlery 106. Because the cutlery 106 is built in to the packaging of the food in the form of the hybrid lid 104 and cutlery 106, the consumer does not have to worry about forgetting other cutlery or the cutlery 106 being accidentally lost from the packaging. Additionally, the hybridization of the lid 104 and the cutlery 106 may reduce the amount of waste associated with consumption of the food in the packaging.

The lid 104 may be configured to be shaped into an eating utensil, i.e. the cutlery 106. The lid 104 may be made of a sheet of material. The material may include plastic, metal, metal foil, and so forth. The lid 104 may include a functional end 106*a* of the cutlery 106 and/or a handle 106*b*. The functional end 106*a* and/or the handle 106*b* may be defined by an outer edge of the lid 104. The functional end 106*a* and/or the handle 106*b* may be defined by a tear strip 104*a* formed in the lid 104. The tear strip may be configured to be torn from between the functional end 106*a* of the cutlery 106 and the rest of the lid 104 material to release the functional end 106*a* from the lid 104. The handle 106*b* may extend from the functional end 106*a* of the cutlery 106.

The functional end 106*a* of the cutlery 106 may be shaped to scoop food out of the container 102. The functional end 106*a* may be flat and/or concave. The functional end 106*a* may have a rounded edge. The functional end 106*a* may be formed in the shape of a spoon, where the edge(s) of the functional end 106*a* are curved and/or the body of the functional end 106*a* is concave. The functional end 106*a* may be formed in the shape of a fork, where the functional end 106*a* includes prongs and/or the body of the functional end 106*a* is concave. The functional end 106*a* may be formed in the shape of a spork, with one section of the functional end 106*a* being continuous and another section of the functional end 106*a* being pronged.

The functional end 106*a* and/or the handle 106*b* of the cutlery 106 may be delineated from the rest of the material of the lid by one or more guiding lines, e.g. the tear strip 104*a*. The guiding lines may be grooves in the lid 104 such that a thickness of the lid 104 is thinner in the groove than elsewhere on the lid 104. The groove may be u-shaped, c-shaped, or v-shaped. The guiding line may be a different color or a different shade than the lid. The guiding line may be the same thickness as the rest of the material of the lid and may be a different color or a different shade than the lid. The guiding line may be a marking on the lid such as a printed marking. The guiding line may include one or more perforations and/or indentations in the lid 104. The perforations may trans-sect the lid 104.

The sheet of material that forms the lid 104 may have an approximately uniform thickness. The sheet of material that forms the lid 104 may have an approximately uniform thickness except along guiding lines formed in the lid 104. The sheet of material that forms the lid 104 may be reinforced, e.g. may be thicker, at the functional end portion 106*a* and/or the handle portion 106*b* of the lid 104.

A secondary lid may be positioned between the container 102 and the hybrid lid 104. The secondary lid may seal food within the container 102. The secondary lid may be a plastic and/or foil sheet attached to the rim of the container 102 and covering the mouth of the container 102. The secondary lid may not be included. The hybrid lid 104 may seal the food in the container 102. For example, the hybrid lid 104 may be glued and/or otherwise adhered to the container 102 to seal the food within the container 102.

Figure 2B:
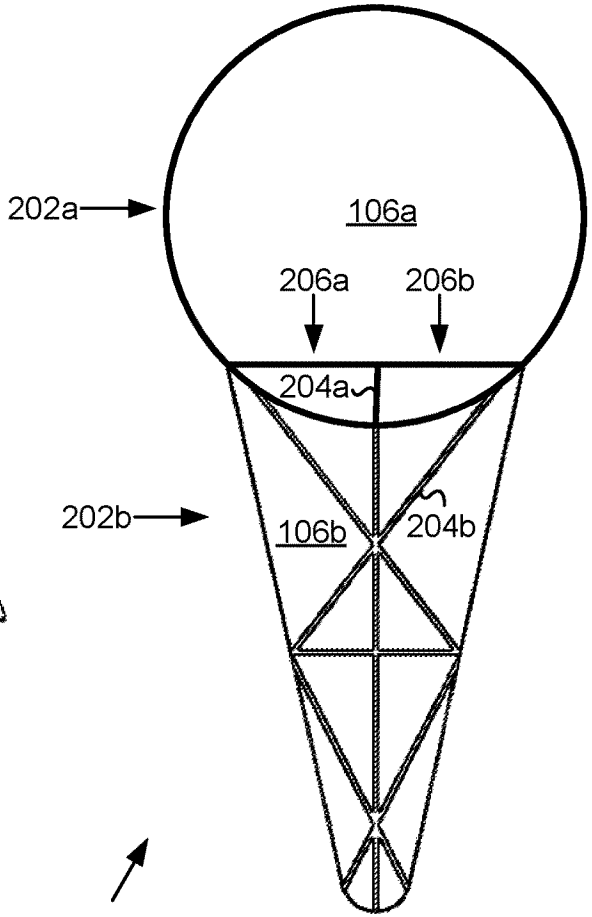
FIG. 2B illustrates a top view of the hybrid lid and cutlery, according to an embodiment.
Figure 2A:
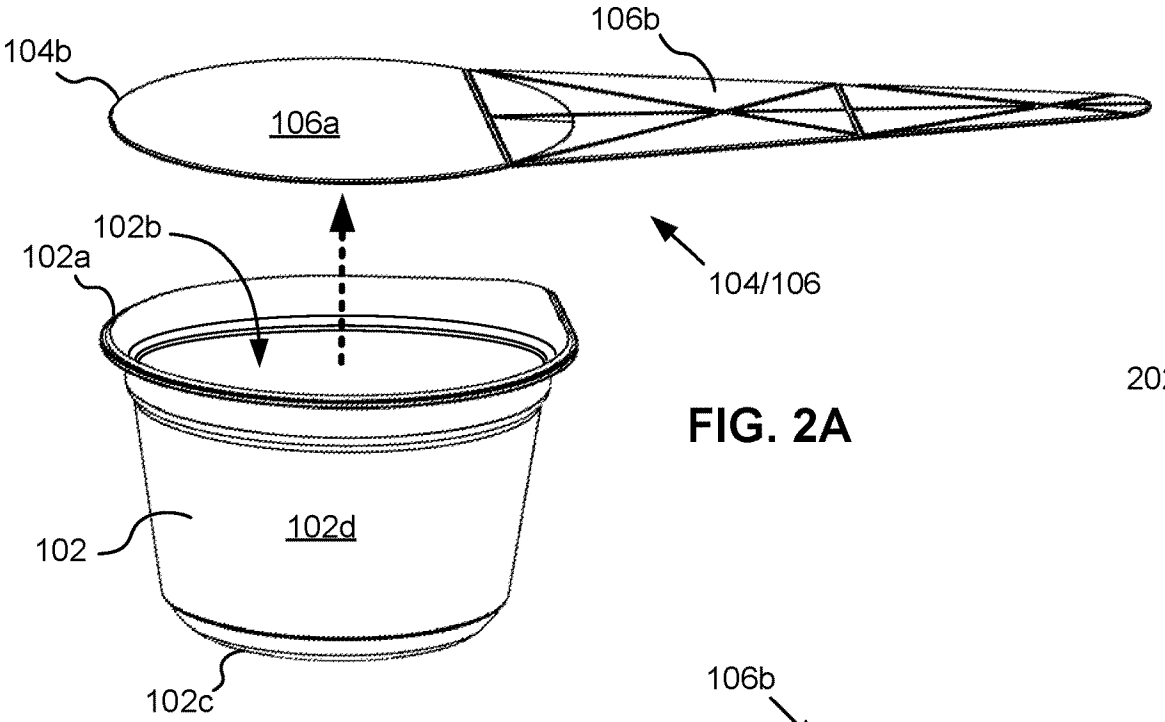
FIG. 2A illustrates an exploded perspective view of the food container with the hybrid lid and cutlery, where the hybrid lid and cutlery is formed of foil, according to an embodiment.

FIG. 2A illustrates an exploded perspective view of the food container 102 with the hybrid lid 104 and cutlery 106, where the hybrid lid 104 and cutlery 106 is formed of foil, according to an embodiment. The hybrid lid 104 may be used to seal food within the container 102 and then may be repurposed as the cutlery 106 when removed from the container 102. The entire lid 104 or a portion of the lid 104 may be repurposed into the cutlery 106 when the lid 104 is removed from the container 102.

The container 102 may include a rim 102*a*, a mouth 102*b* defined by the rim 102*a*, a floor 102*c* opposite the container mouth 102*b*. and/or a wall that extends between the rim 102*a* and the floor 102*c*. The lid 104 may be attached to the rim 102*a*. For example, the lid 104 may be adhered to the rim 102*a* by an adhesive. The lid 104 may be attached to the rim 102*a* by a compression fit over the rim. The lid 104 may include a corresponding rim that has a first diameter that is smaller than an outside diameter of the rim 102*a* and a second diameter that is greater than or equal to the outside diameter of the rim 102*a*. The corresponding rim of the lid 104 may flex as it is pressed onto the rim 102*a* of the container 102 and then snap down on the container 102, being held in place by the portion of the rim of the lid 104 that has a narrower diameter than the rim 102*a* of the container. The lid 104 may cover the mouth 102*b* of the container.

The functional end 106*a* of the cutlery 106 may encompass an entire portion of the lid 104 that covers the mouth 102*b* of the container. Accordingly, the functional end 106*a* may be defined by an outer edge 104*b* of the lid 104. At least a portion of the functional end 106*a* of the cutlery 106 may be sealed and/or adhered to the rim 102*a* of the container 102.

FIG. 2B illustrates a top view of the hybrid lid 104 and cutlery 106, according to an embodiment. The hybrid lid 104 and cutlery 106 may include guiding lines that visually and/or tactilely guide a consumer in shaping the lid 104 into the cutlery 106. For example, the guiding lines may show the consumer where the fold the lid 104. The guiding lines may tactilely guide the consumer by making it easier for the consumer to fold the lid 104 along the guiding lines than off the guiding lines. Thus, as a consumer folds the lid 104 into the cutlery 106, the consumer may experience resistance when trying to fold the lid 104 off the guiding lines and acquiescence when trying to fold the lid 104 on the guiding lines.

The hybrid lid 104 and cutlery 106 may include a first planar section 202*a* and a second planar section 202*b*. The first planar section 202*a* may be formed approximately in the shape of a functional end of an eating utensil, e.g. the functional end 106*a* of the cutlery 106. The second planar section 202*b* may be formed approximately in the shape of a handle of the eating utensil, e.g. the handle 106*b* of the cutlery 106. The second planar section 202*b* may be continuous with the first planar section 202*a*. For example, in manufacturing the lid 104, the first planar section 202*a* and the second planar section 202*b* may be cut by a single die from the same sheet of material.

The handle 106*b* may include a first guiding line 204*a* and/or a second guiding line 204*b*, where "guiding line" may refer to a visible line that acts as a guide. The first guiding line 204*a* and/or the second guiding line 204*b* may be straight or approximately straight. The first guiding line 204*a* and/or the second guiding line 204*b* may be curved.

The first guiding line 204*a* may extend along a length of the handle 106*b* away from the functional end 106*a* and towards an end of the handle 106*b* opposite the functional end 106*a*. The first guiding line 204*a* may extend along the length of the handle 106*b* from the functional end 106*a* to the end of the handle 106*b* opposite the functional end 106*a*. The first guiding line 204*a* may extend between the functional end 106*a* of the cutlery 106 and the end of the handle 106*b* and may not reach or touch the functional end 106*a* and/or the end of the handle 106*b*. The first guiding line 204*a* may divide the handle 106*b* into a first side 206*a* and a second side 206*b*.

The second guiding line 204*b* may extend away from the first guiding line 204*a* towards a side edge of the handle 106*b*. The second guiding line 204*b* may extend from the first guiding line 204*a* to the side edge of the handle 106*b*. The second guiding line 204*b* may intersect with the first guiding line 204*a*. The second guiding line 204*b* may extend between the first guiding line 204*a* and the side edge of the handle 106*b* and may not reach or touch the first guiding line 204*a* and/or the side edge of the handle 106*b*. The second guiding line 204*b* may extend away from an intersection of the first planar section 202*a* with the second planar section 202*b* and towards the side edge of the handle 106*b*. The second guiding line 204*b* may extend from the intersection of the first planar section 202*a* with the second planar section 202*b* to the side edge of the handle 106*b*. The second guiding line 204*b* may extend between the intersection of the first planar section 202*a* and the second planar section 202*b* and the side edge of the handle 106*b* and may not reach or touch the intersection and/or the side edge. The second guiding line 204*b* may extend away from the first guiding line 204*a* towards the side edge of the handle 106*b* and towards the intersection of the first planar section 202*a* with the second planar section 202*b*. The second guiding line 204*b* may extend from the first guiding line 204*a* to the side edge of the handle 106*b* and to the intersection of the first planar section 202*a* with the second planar section 202*b*. The second guiding line 204*b* may extend between the first guiding line 204*a* and a portion of the side edge of the handle 106*b* where the first planar section 202*a* and the second planar section 202*b* meet without reaching or touching the first guiding line 204*a* and/or the side edge at the intersection.

The handle 106*b* may include two or more second guiding lines 204*b*. For example, the second side 206*b* of the handle 106*b* may mirror the first side 206*a*. The handle 106*b* may include two or more iterations of the second guiding line 204*b* on the same side of the handle 106*b*. For example, a first iteration of the second guiding line 204*b* may extend one direction and a second iteration of the second guiding line 204*b* may extend an opposite direction on the same side of the handle 106*b*.

The first guiding line 204*a* and/or the second guiding line 204*b* may be drawn and/or printed on the cutlery 106. Accordingly, the first guiding line 204*a* and/or the second guiding line 204*b* may be a different color and/or shade than the rest of the cutlery 106 and/or lid 104. The first guiding line 204*a* and/or the second guiding line 204*b* may be etched into the cutlery 106. For example, the first guide line 204*a* and/or the second guiding line 204*b* may be a groove such that a thickness of the material of the cutlery 106 is thinner in the groove than elsewhere on the cutlery. This may enable the cutlery 106 to be folded along the guiding lines and may prevent folding of the cutlery 106 in areas that would undermine and/or prevent shaping of the lid 104 into the cutlery 106.

Figure 2C:
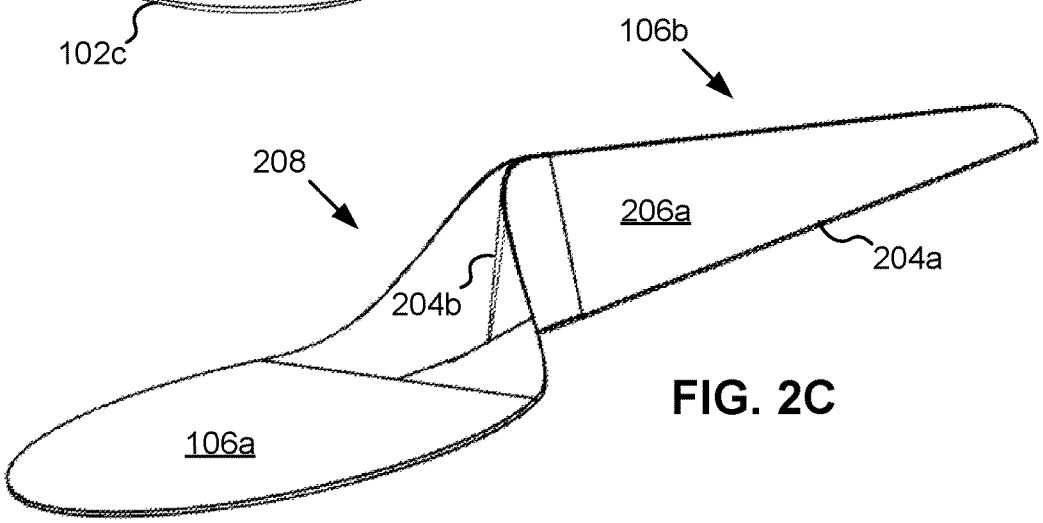
FIG. 2C illustrates a view of the lid folded into the cutlery, according to an embodiment.

FIG. 2C illustrates a view of the lid 104 folded into the cutlery 106, according to an embodiment. The cutlery 106 may be in a shape that a consumer is accustomed to using, with a narrow handle 106*b* that fits comfortably and naturally in the consumer's hand and a broad functional end 106*a* that is broad enough to capture a satisfying mouthful of food from the container 102. Because the cutlery 106 is shaped in a form that the consumer is accustomed to, consumers may be more likely to rapidly adopt use of the cutlery 106. Consumers may also seek out packaged foods that include the hybrid lid 104 and cutlery 106 for convenience. This may entice food packaging entities to incorporate the hybrid lid 104 and cutlery 106 into their packaging in order to increase and/or maximize sales and obtain a competitive advantage.

The first guiding line 204*a* may define a first fold of the handle 106*b*. The first fold of the handle 106*b* may bring the first side 206*a* and the second side 206*b* together. As the first side 206*a* and the second side 206*b* of the handle 106*b* are together and the handle 106*b* is folded along the first guiding line 204*a*, the functional end 106*a* may form an arch shape. The second guiding line 204*b* may define a second fold of the handle 106*b*. The second fold of the handle 106*b* may be outwards such that a portion of the first side 206*a* adjacent to the functional end 106*a* and a portion of the second side 206*b* also adjacent to the functional end 106*a* are folded away from each other. As the first side 206*a* and the second side 206*b* of the handle 106*b* are together, as the handle 106*b* is folded along the first guiding line 204*a*, and the handle 106*b* is further folded along the second guiding line 204*b*, the functional end 106*a* may form a concave shape. The handle 106*b* may be folded along the second guiding line 204*b* such that the functional end 106*a* is flat.

As the handle 106*b* is folded along the first guiding line 204*a* and the second guiding line 204*b*, a transition region 208 between the handle 106*b* and the functional end 106*a* may be formed. The handle 106*b* may be approximately parallel to a first plane. The functional end 106*a* may be approximately parallel to a second plane. The first plane and the second plane may be approximately orthogonal to each other and/or may intersect with each other. The transition region 208 may be approximately parallel to a third plane. The third plane may be approximately orthogonal to, or may intersect, the first plane and/or the second plane.

Figure 3A:
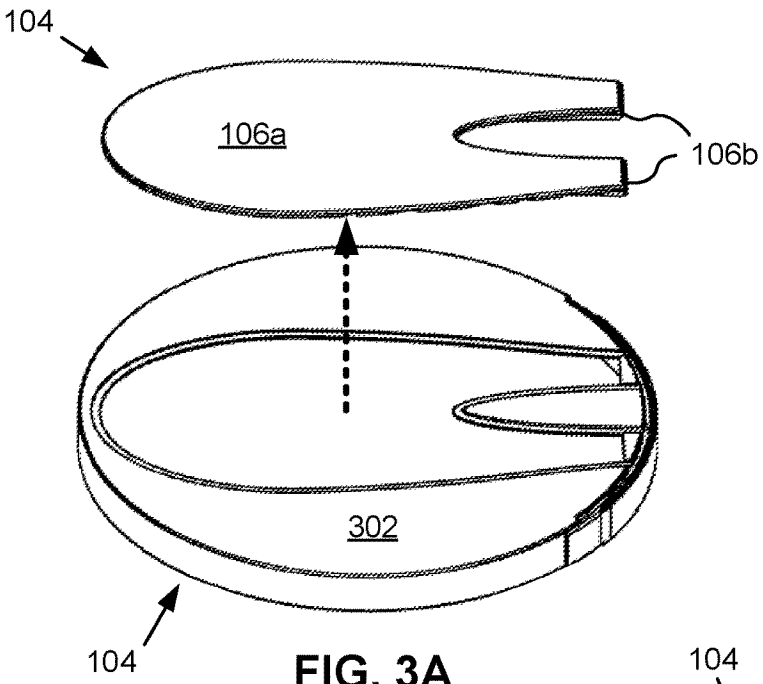
FIG. 3A illustrates an exploded view of the hybrid lid and cutlery where the cutlery is removable from other parts of the lid, according to an embodiment.

FIG. 3A illustrates an exploded view of the hybrid lid 104 and cutlery 106 where the cutlery 106 is removable from other parts of the lid 104, according to an embodiment. Having the cutlery 106 as a die-cut blank in the lid 104 may allow for the cutlery 106, including the functional end 106*a* and/or the handle 106*b*, to be shaped in a different shape from the mouth 102*b* of the container 102. Having the cutlery 106 as a blank in the lid 104 may ensure the functional end 106*a* fits through the mouth 102*b* and/or within the container 102. The cutlery 106 may be maneuverable within the container 102 to make it easy for the consumer to scoop out food within the container 102 and/or reach food that is against corners and/or edges of the container 102.

The cutlery 106 may be detachable from other portions of the lid 104. The lid 104 may be a substrate that is stamped with the shape of the cutlery 106 to delineate the cutlery 106 from excess material 302 of the lid 104. The lid 104 may be partially stamped to form the delineation such that the cutlery 106 is retained with the lid 104 in covering the mouth 102*b* of the container 102. The stamping may be deep enough, and the lid thin enough where stamped, that the cutlery 106 may be released from the lid 104 by a consumer exerting pressure by the consumer's hand and/or fingers on the cutlery 106 counter to pressure on the lid 104.

Figure 3B:
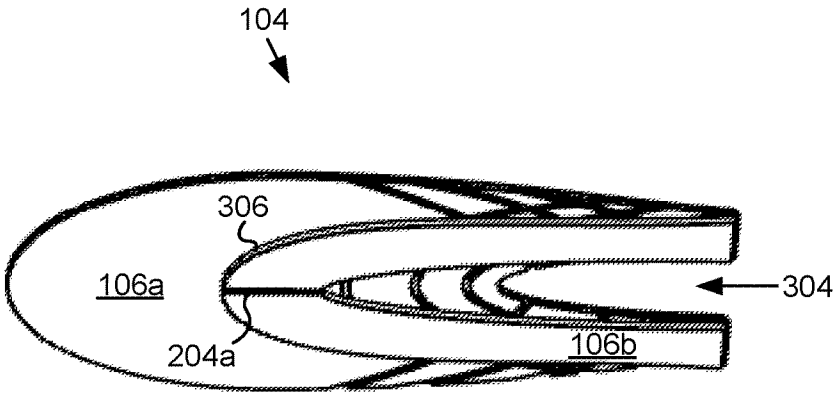
FIG. 3B illustrates an underside view of the cutlery in a folded arrangement as the cutlery portion of the lid would be when it is attached to the lid, according to an embodiment.

FIG. 3B illustrates an underside view of the cutlery 106 in a folded arrangement as the cutlery 106 portion of the lid 104 would be when it is attached to the lid 104, according to an embodiment. The mouth 102*b* of the container 102 may be narrower than the length that a consumer is accustomed to for cutlery. The mouth 102*b* of the container 102 may have a greatest width that is smaller than a length of the cutlery 106 from an end of the functional end 106*a* to the opposite end of the handle 106*b*. When the hybrid lid 104 and cutlery 106 is packaged with the container 102, the handle 106*b* may be folded against the functional end 106*a* to fit the size of the mouth 102*b*. Folding the handle 106*b* against the functional end 106*a* may also prevent to handle 106*b* from being damaged as the food packaging is transported and/or during packaging of food in the container 102.

The handle 106*b* may be folded against the functional end 106*a* of the cutlery 106 as the lid 104 is attached to the container 102. The handle 106*b* may be folded towards and/or against the functional end 106*a* such that the handle 106*b* is between the functional end 106*a* and the mouth 102*b* of the container. The handle 106*b* may be folded towards and/or against the functional end 106*a* such that the functional end 106*a* is between the mouth 102*b* and the handle 106*b*. The handle 106*b* may be folded against the container 102 as the lid 104 is attached to container 102 such that the handle 106*b* is adjacent to the wall 102*d* of the container 102.

When lid 104 is adhered to the rim 102*a* of the container 102, the lid 104 may be directly adjacent to food within the container 102. The handle 106*b* may be folded over the functional end 106*a* outside the container 102 to prevent food from touching the handle 106*b*. The handle 106*b* may be adhered to the functional end 106*a* with a non-toxic and/or low-tack adhesive to retain the handle 106*b* against the functional end 106*a*. When a secondary lid is used between the lid 104 and the mouth 102*b* of the container 102, the handle may be folded under the functional end 106*a* between the functional end 106*a* and the secondary lid.

The handle 106*b* may include an opening 304 between the first side 206*a* and the second side 206*b*. The opening 304 may be oval-shaped, circular, triangular, or rectangular. The opening 304 may extend between the functional end 106*a* of the cutlery 106 and an end segment 306 of the handle 106*b*. The opening 304 may extend from the functional end 106*a* to the end segment 306. The first guiding line 204*a* may extend from and/or between the opening 304 and the end of the handle 106*b*. The second guiding line 204*b* may extend from the opening 304 to the side edge of the handle 106*b* and/or the intersection of the handle 106*b* with the functional end 106*a* of the cutlery 106.

Figure 3C:
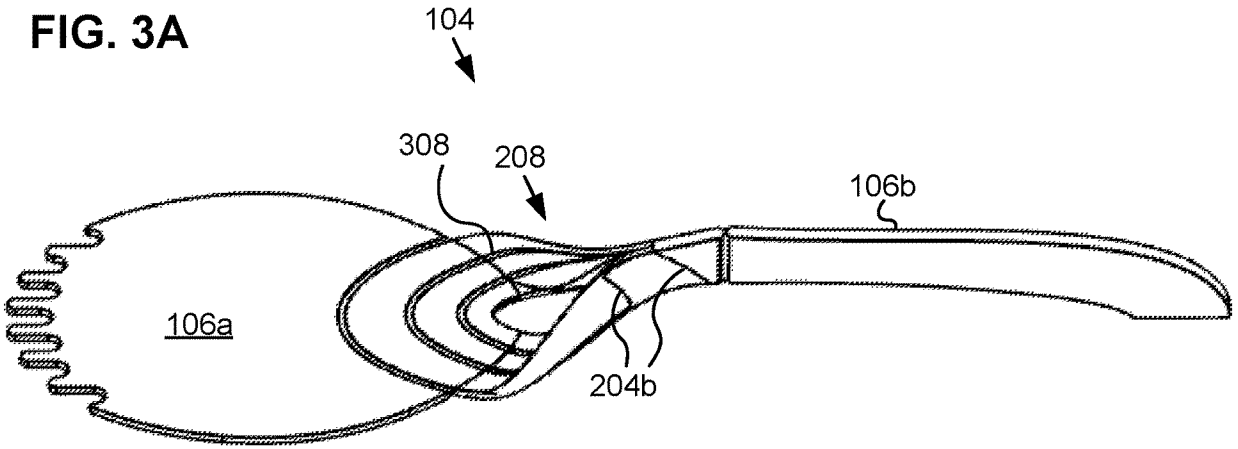
FIG. 3C illustrates a view of the cutlery detached from the lid and then refolded to form a functional end of the cutlery and a handle of the cutlery, according to an embodiment.

FIG. 3C illustrates a view of the cutlery 106 detached from the lid 104 and then refolded to form the functional end 106*a* and the handle 106*b*, according to an embodiment. The handle 106*b* may have a narrower width due to the opening 304 and may have curvature that corresponds to the shape of the opening 304. This may put the shape of the handle 106*b* in a form that is comfortable for the consumer to hold and may closely imitate the shape of other cutlery the consumer is accustomed to using.

The handle 106*b* and/or the functional end 106*a* may include a third guiding line 308. The third guiding line may extend from the opening 304 on the first side 206*a* of the handle 106*b*, loop around the opening 304 at the end of the opening 304 adjacent to the functional end 106*a* of the cutlery 106, and/or may extend back towards the opening 304 along the second side 206*b* of the handle 106*b*. The third guiding line 308 may be similarly structured to the first guiding line 204*a* and/or the second guiding line 204*b* (i.e. the third guiding line 308 may be drawn on the lid 104, pressed into the lid 104, and so forth). The third guiding line may enable the portion of the handle 106*b* in the transition region 208 to fold back towards the functional end 106*a* of the cutlery 106 as the first side 206*a* and the second side 206*b* of the handle 106*b* are folded away from each other along the second guiding line 204*b* in the transition region 208. The third guiding line may enable the transition region 208 to curve from the handle 106*b* to the functional end 106*a*.

Figure 3D:
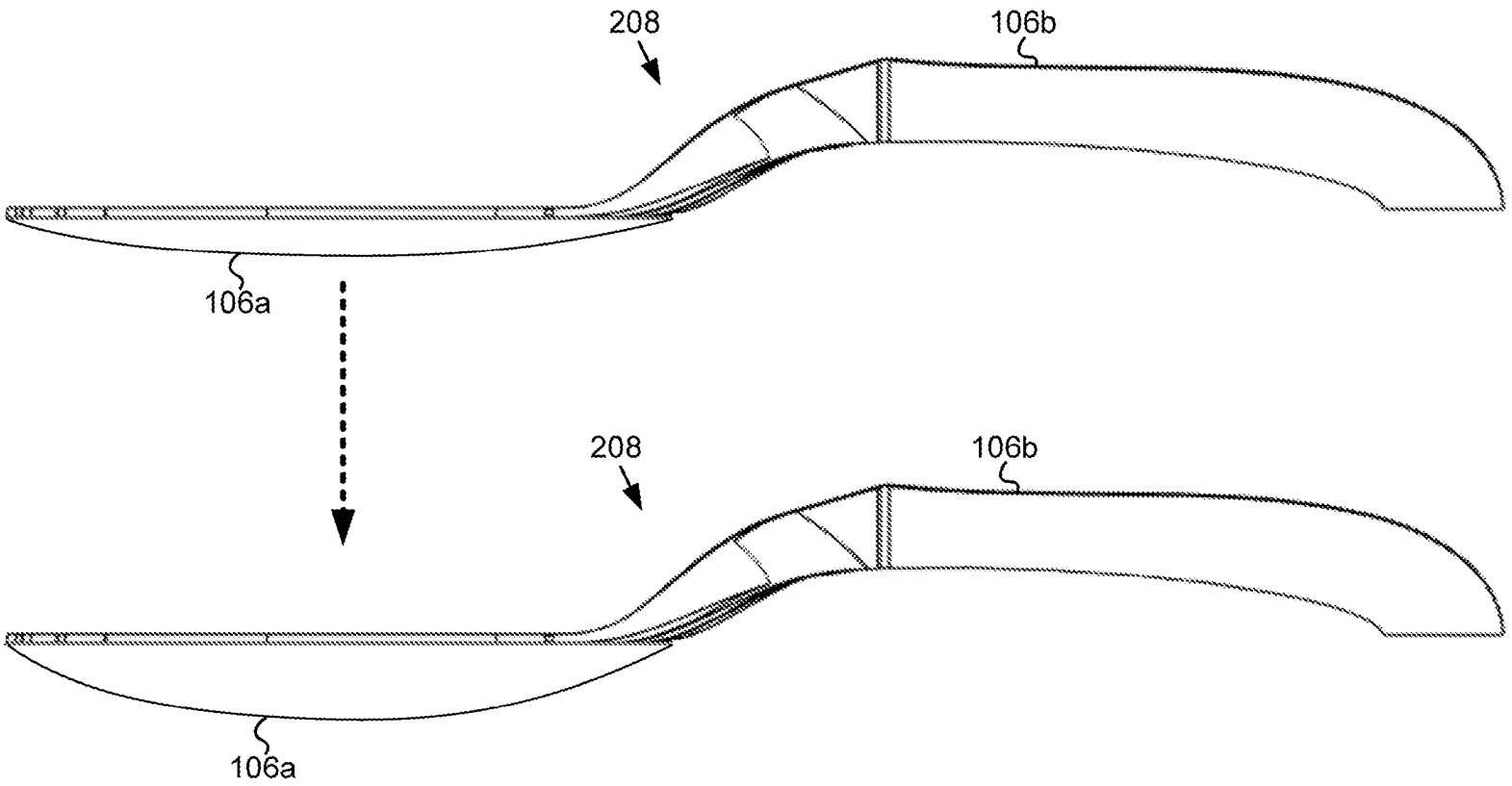
FIG. 3D illustrates the cutlery with different degrees of concavity, according to an embodiment.

FIG. 3D illustrates the cutlery 106 with different degrees of concavity, according to an embodiment. Different consumers may have different preferences regarding the degree of concavity of the cutlery 106. Additionally, different types of foods may be suited to different degrees of concavity of the cutlery 106. Accordingly, the cutlery may be configured to be formed with differing degrees of concavity. This may improve adoption of the hybrid lid 104 and cutlery 106 by consumers and food packagers.

The handle 106*b* may include multiple second guiding lines 204*b*. Folding the handle along a first iteration of the second guiding line 204*b* may give the functional end 106*a* of the cutlery 106 a first degree of concavity. Folding the handle along a second iteration of the second guiding line 204*b* may give the functional end 106*a* a second degree of concavity that is different from the first degree of concavity. The degree of concavity may correspond to a depth of the functional end 106*a*.

Figure 4A:
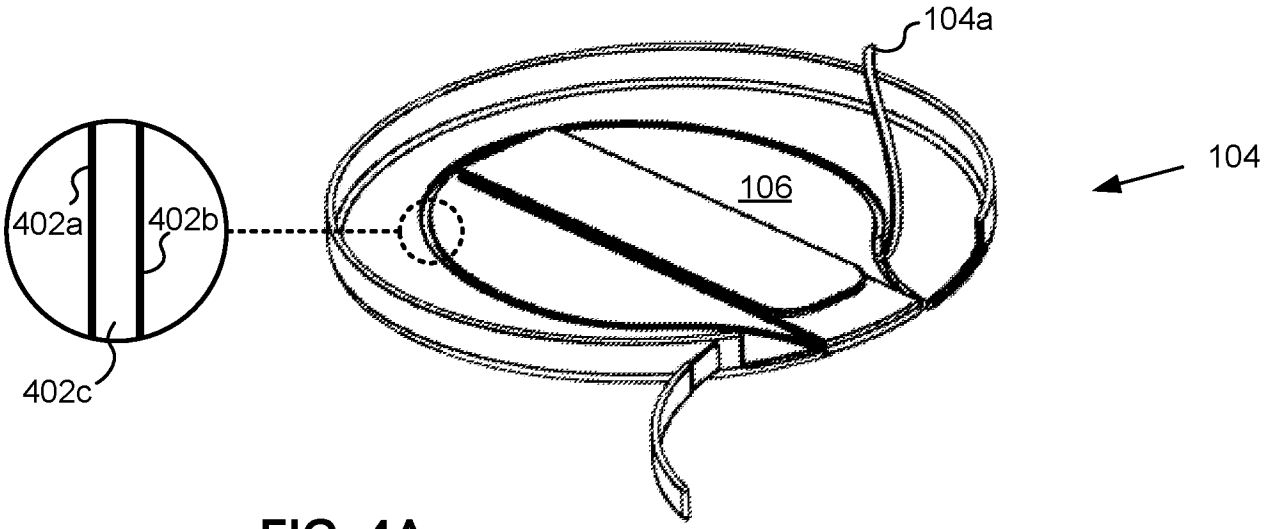
FIG. 4A illustrates an underside view of the hybrid lid and cutlery with a tear strip that enables the cutlery to be separated from the rest of the lid, according to an embodiment.

FIG. 4A illustrates an underside view of the hybrid lid 104 and cutlery 106 with the tear strip 104*a* that enables the cutlery 106 to be separated from the rest of the lid 104, according to an embodiment. Holding the lid 104 and cutlery 106 together with the tear strip 104*a* may prevent the cutlery 106 from being inadvertently dislodged from the lid 104, such as during packaging of the food and/or transport of the packaged food.

The tear strip 104*a* may be configured to be torn from between the lid 104 and the functional end 106*a* of the cutlery 106 to release the cutlery 106 from the lid 104. The tear strip 104*a* may include a first trace 402*a* and a second trace 402*b*, where the first trace 402*a* and the second trace 402*b* have a thickness that is less than a thickness of the lid 104. For example, the first trace 402*a* and the second trace 402*b* may be formed by pressing a die into the lid 104 without fully perforating the lid 104. The tear strip 104*a* may include a pullstring 402*c* between the first trace 402*a* and the second trace 402*b*. The first trace 402*a*, the second trace

402*b*, and/or the pullstring 402*c* may be formed of the same material as the lid 104. The pullstring 402*c* may be of a similar thickness as the lid 104. A pull-tab may hang from the tear strip 104*a* away from the lid 104 to enable a consumer to grasp the tear strip 104*a* to pull the pullstring 402*c* out of the lid 104. The first trace 402*a* and/or the second trace 402*b* may be thin enough to allow the consumer to pull the pullstring 402*c* from the lid 104 by hand.

The lid 104 may include a rip tab. The rip tab may be a piece of the rim 104*a* of the lid 104 that may be ripped from the lid 104 to release the lid 104 from the container 102. The rip tab may be partially severed from the lid 104. The rip tab may be held at one end to the lid 104 by a thin trace of the material of the lid 104. The rip tab may be an extension of the rim 104*a* of the lid 104.

Figure 4B:
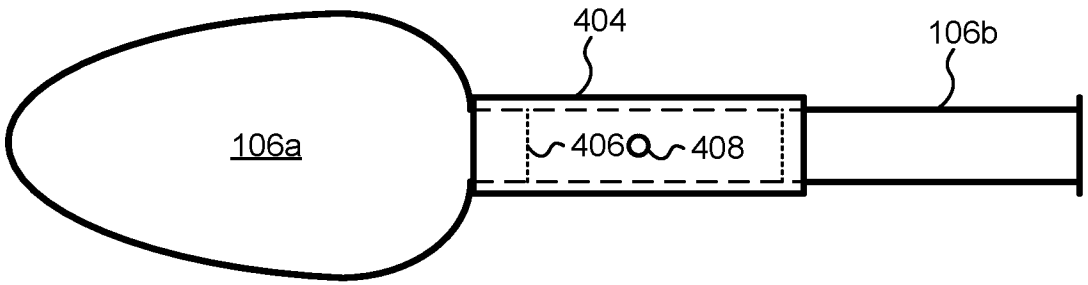
FIG. 4B illustrates the cutlery with a sleeve positioned over folds in the handle of the cutlery, according to an embodiment.

FIG. 4B illustrates the cutlery 106 with a sleeve 404 positioned over folds 406 in the handle 106*b* of the cutlery 106, according to an embodiment. The sleeve 404 may hold the handle 106*b* rigid while the consumer uses the cutlery 106. This may allow for the handle 106*b* to be a narrow shaft that a consumer may be accustomed to in cutlery 106, while still allowing the handle 106*b* to be folded to fit over the mouth 102*b* as part of the hybrid lid 104 and cutlery 106.

The handle 106*b* may be a shaft that is narrower than the functional end 106*a* of the cutlery 106. The shaft may be folded over at the folds 406 as the hybrid lid 104 and cutlery 106 is attached to the container 102. When the cutlery 106 is removed from the lid 104, the handle 106*b* may be unfolded and extended from the functional end 106*a* of the cutlery 106. The sleeve 404 may be positioned over the folds 406 to hold the handle 106*b* rigid while the consumer uses the cutlery 106. The sleeve 404 may include a detent 408 and the handle 106*b* may include a corresponding raised portion, or vice-versa. As the sleeve 404 is slid over the folds 406, the raised portion may slip into the detent 408 to secure the sleeve 404 over the folds 406.

Figure 5B:
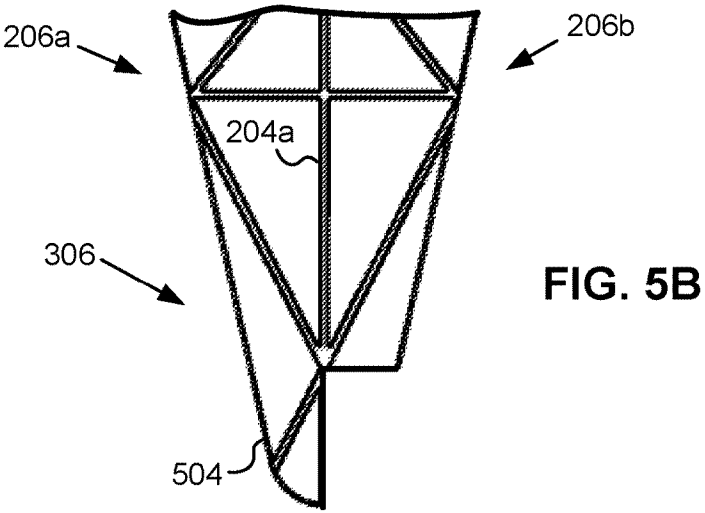
FIG. 5B illustrates the end segment of the handle with one side longer than the other, according to an embodiment.
Figure 5D:
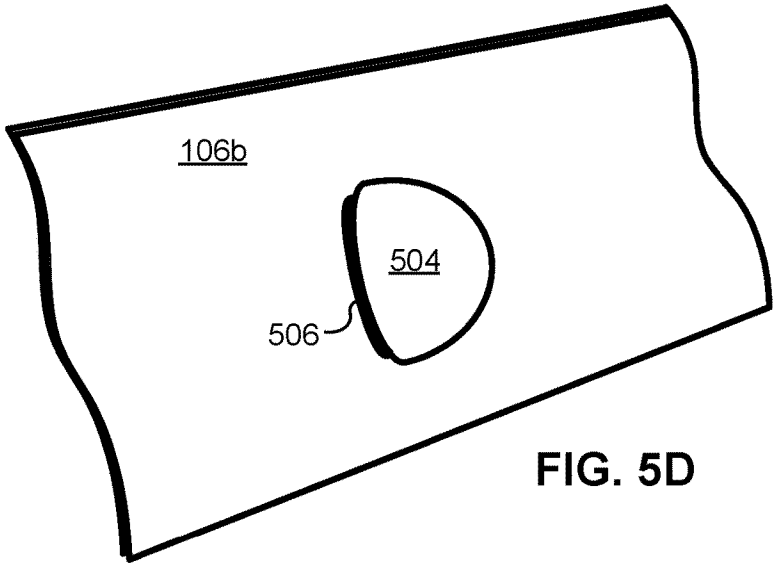
FIG. 5D illustrates the handle with the tab on one side of the handle pressed through a hole in the other side of the handle, according to an embodiment.
Figure 5A:
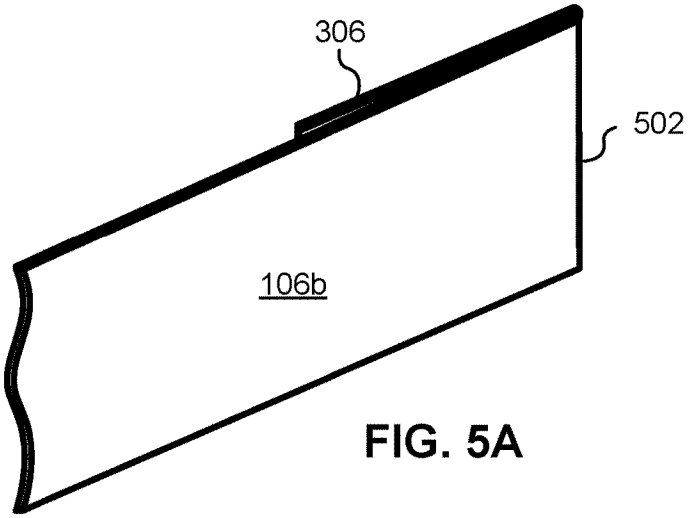
FIG. 5A illustrates an end segment of the handle folded over to hold the sides of the handle together, according to an embodiment.

FIG. 5A illustrates the end segment 306 of the handle 106*b* folded over to hold the sides of the handle 106*b* together, according to an embodiment. This may secure the sides of the handle 106*b* together and prevent them from separating as the consumer uses the cutlery 106.

The handle 106*b* may include a fourth guiding line 502. The fourth guiding line 502 may mark a fold in the handle 106*b* that holds the first side 206*a* and the second side 206*b* together. The fourth guiding line 502 may be on an opposite face of the handle 106*b* from the first guiding line 204*a* and/or the second guiding line 204*b*. The fourth guiding line 502 may be approximately perpendicular to the first guiding line 204*a*. The fourth guiding line 502 may approximate to the end of the handle 106*b* opposite the functional end 106*a* of the cutlery 106. The fourth guiding line 502 may delineate the end segment 306 of the handle 106*b*. Folding the handle 106*b* along the fourth guiding line 502 as the handle 106*b* is also folded along the first guiding line 204*a* may hold the first side 206*a* and the second side 206*b* of the handle 106*b* together.

FIG. 5B illustrates the end segment 306 of the handle 106*b* with one side longer than the other, according to an embodiment. Having one side longer than the other may enable the sides of the handle 106*b* to be secured together and prevent them from separating as the consumer uses the cutlery 106.

The end segment 306 may include a tab 504 on the first side 206*a* of the handle 106*b*. The tab may extend further from the handle 106*b* than the second side 206*b* of the handle 106*b*. As the handle 106*b* is folded along the first guiding line 204*a*, the tab may be folded over the second side 206*b* of the handle to join and/or hold the first side 206*a* and the second side 206*b* together.

Figure 5C:
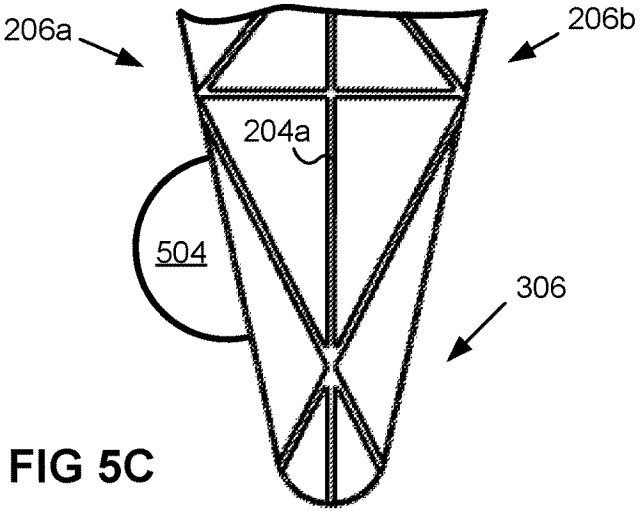
FIG. 5C illustrates an example of a tab that holds the sides of the handle together, according to an embodiment.

FIG. 5C illustrates another example of the tab 504, according to an embodiment. The tab 504 may enable the sides of the handle 106*b* to be secured together and prevent them from separating as the consumer uses the cutlery 106.

The tab 504 may be configured (i.e. in shape and/or position on the handle 106*b*) to hold the first side 206*a* and the second side 206*b* of the handle 106*b* together as the handle is folded along the first guiding line 204*a*. The tab 504 may extend from a side edge of the handle 106*b*, such as from the first side 206*a* of the handle 106*b*. A guiding line, which may be similar to other guiding lines described herein, may mark a folding point of the tab 504.

FIG. 5D illustrates the handle 106*b* with the tab 504 on one side of the handle 106*b* pressed through a hole 506 in the other side of the handle 106*b*, according to an embodiment. The tab 504 may secure the sides of the handle 106*b* together and prevent them from separating as the consumer uses the cutlery 106.

The tab 504 may be a nip that extends from a surface of the handle 106*b* on a side of the handle 106*b* (e.g. the first side 206*a*). The tab 504 may extend from a side of the surface of the handle 106*b* that faces the other side of the handle 106*b* as the handle 106*b* is folded along the first guiding line 204*a*. The handle 106*b* may include a slot and/or hole 506 that opposes the tab 504, i.e. that is on the opposite side of the handle 106*b*. As the handle 106*b* is folded along the first guiding line 204*a*, the tab 504 may pass into and/or through the hole 506. The tab 504 may have a diameter that is larger than the diameter of the hole 506. As the securing tab is positioned in the hole 506, the tab 504 may hold the first side 206*a* and the second side 206*b* of the handle 106*b* together. The tab 504 may be a flap that is partially cut from the handle 106*b* so that the tab 504 may be folded away from the handle 106*b* while still attached to the handle 106*b*. The hole 506 may be a slot, and the flap may pass through the slot and fold back against the handle 106*b* to secure the sides of the handle 106*b* together.

Figure 5E:
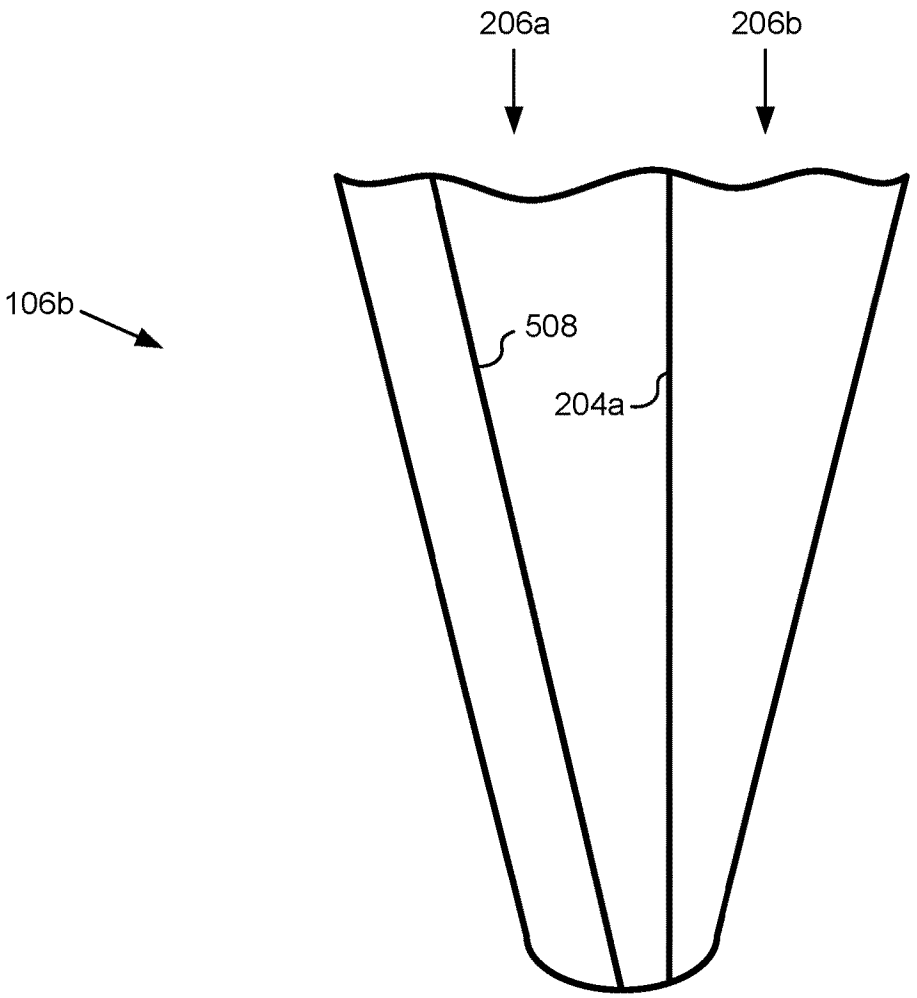
FIG. 5E illustrates the handle with the first side of the handle being wider than the second side of the handle, according to an embodiment.

FIG. 5E illustrates the handle 106*b* with the first side 206*a* being wider than the second side 206*b*, according to an embodiment. The first side 206*a* may secure the sides of the handle 106*b* together and prevent them from separating as the consumer uses the cutlery 106.

The first side 206*a* of the handle 106*b* may be wider than the second side 206*b* of the handle 106*b* as measured from the first guiding line 204*a*. The handle 106*b* may include a fifth guiding line 508. The fifth guiding line 508 may be on a same face of the handle 106*b* as the first guiding line 204*a*. The fifth guiding line 508 may be approximately parallel to the first guiding line 204*a*. The fifth guiding line 508 may follow a path that intersects with the first guiding line 204*a*. The fifth guiding line 508 may be spaced from the first guiding line 204*a* by an amount approximately equal to a width of the second side 206*b* of the handle 106*b*. Folding the first side 206*a* of the handle 106*b* along the fifth guiding line 508 over the second side 206*b* of the handle 106*b* as the handle 106*b* is also folded along the first guiding line 204*a* may hold the first side 206*a* and the second side 206*b* together.

Figure 5F:
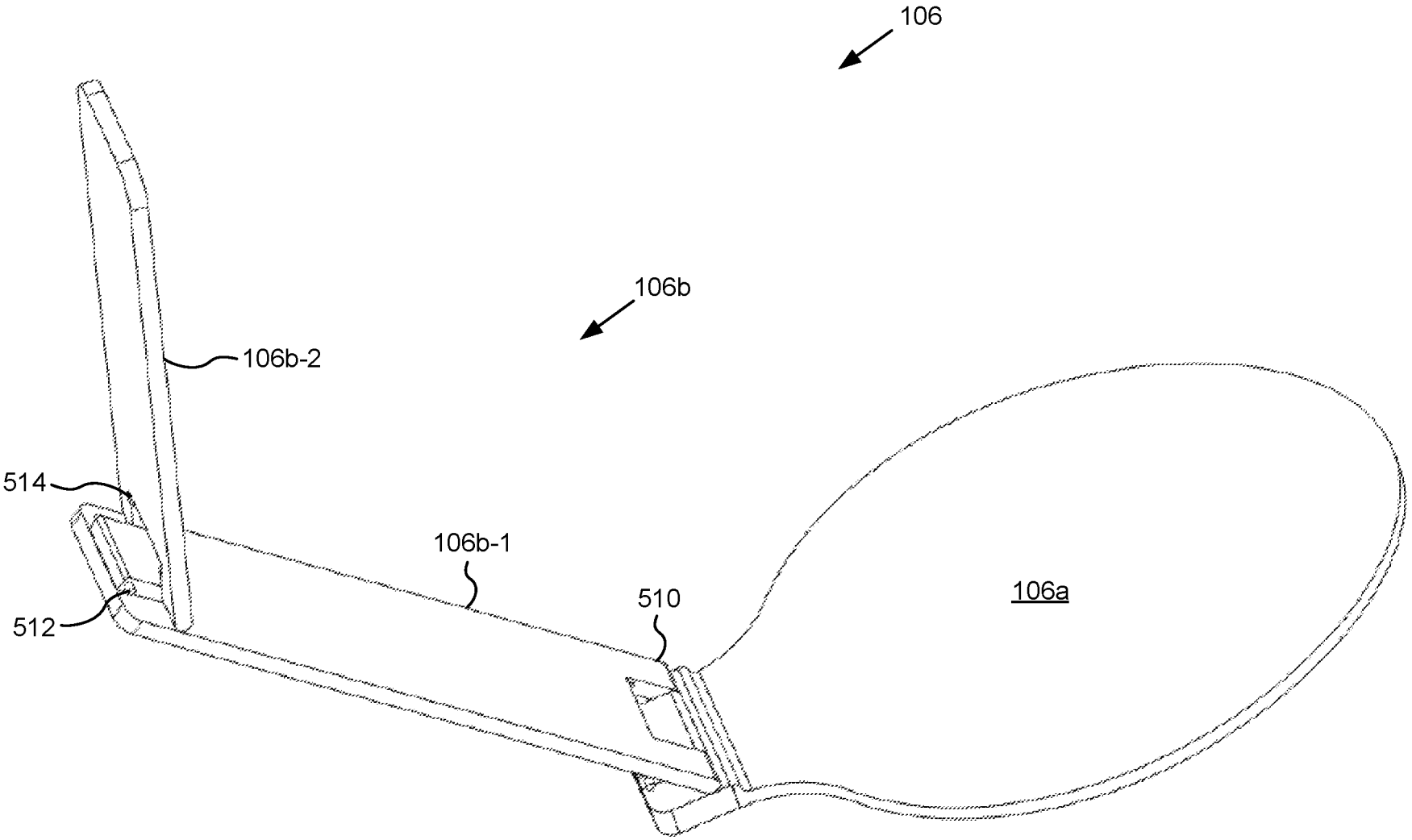
FIG. 5F illustrates the cutlery with a rigid and foldable handle, according to an embodiment.

FIG. 5F illustrates the cutlery 106 with a rigid and foldable handle 106*b*, according to an embodiment. The handle 106*b* may be rigid to support scooping of food from the container 102. Some food products stored in the container 102 may have high viscosity, such as yogurt, ice cream, and/or mashed potatoes. Some food products stored in the container 102 may be relatively heavy when compared to other foods. Indeed, some consumers may scoop heaping mouthfuls with the cutlery 106. In such cases as those where the food has high viscosity, is relatively heavy, or is scooped in abundance, having a rigid handle may ensure the integrity of the cutlery 106 and uninterrupted enjoyment of the food by the consumer. Having a foldable handle 106*a* that is configured to be formed into a rigid shape may also enable the cutlery to be conveniently integrated with the lid 104 to ensure the consumer has the cutlery 106 when the consumer is ready to eat.

The handle 106*b* may be segmented into a first handle portion 106*b*-1 and a second handle portion 106*b*-2. The first handle portion 106*b*-1 may be pivotally coupled to the functional end 106*a* of the cutlery 106 by a hinge 510. The second handle portion 106*b*-2 may be pivotally coupled to the first handle portion 106*b*-1 by a second instance of the hinge 510 opposite the functional end 106*a*. The hinge 510 may be offset from the ends of the functional end 106*a* and the first handle portion 106*b*-1. The end of the functional end 106*a* and the end of the first handle portion 106*b*-1 may include a raise portion with a pin 512. Corresponding ends of the first handle portion 106*b*-1 and the second handle portion 106*b*-2, respectively, may include catches 514 that catch the pin 512 when the handle 106*b* is extended flat from a folded position. The pin 512 and catch 514 may secure the handle 106*b* in the flat arrangement and/or may prevent the handle 106*b* from refolding as the consumer uses the cutlery 106.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods, and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions, and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements, and/or properties may be claimed through amendment of those claims or presentation of new claims in the present application or in a related application. Such amended or new claims, whether they are directed to the same example or a different example and whether they are different, broader, narrower, or equal in scope to the original claims, are to be considered within the subject matter of the examples described herein.

The invention claimed is:

1. An apparatus, comprising:

a lid removably attached to a container rim, wherein:

the lid is configured to be shaped into an eating utensil;

the lid is made of a sheet of plastic material, a sheet of metallic material, or a sheet that is a combination of plastic and metallic material; and the lid comprises:

a scoop defined by:

an outer edge of the lid; or a tear strip formed in the lid, wherein the tear strip is configured to be torn from between the lid and the scoop to release the scoop from the lid; and a handle that extends from the scoop, wherein:

the handle is folded against the scoop while the lid is attached to the container rim;

the handle comprises:

a first guiding line extending along a length of the handle away from the scoop and towards an end of the handle opposite the scoop, wherein the first guiding line divides the handle into a first side and a second side; and a second guiding line extending away from the first guiding line towards a side edge of the handle;

wherein the first guiding line defines a first fold of the handle that brings the first side and the second side of the handle together, wherein, as the first side and the second side of the handle are brought together and when the handle is folded along the first guiding line, the scoop forms an arch shape; and wherein the second guiding line defines a second fold of the handle, wherein, as the first side and the second side of the handle are brought together, as the handle is folded along the first guiding line, and when the handle is further folded along the second guiding line, the scoop forms a concave shape.

2. The apparatus of claim 1, wherein:

the first guiding line and the second guiding line comprise a groove in the lid such that a thickness of the lid is thinner in the groove than elsewhere on the lid; and the groove is u-shaped, c-shaped, or v-shaped.

3. The apparatus of claim 1, wherein one of the first guiding line and the second guiding line is a different color or a different shade than a remainder of the lid.

4. The apparatus of claim 1, wherein one of the first guiding line and the second guiding line comprises a set of perforations in the lid, wherein:

the perforations are indentations in the lid; or the perforations transect the lid.

5. The apparatus of claim 1, further comprising a securing tab extending from the first side of the handle or the second side of the handle, wherein the securing tab is configured to hold the first side of the handle and the second side of the handle together as the handle is folded along the first guiding line.

6. The apparatus of claim 5, wherein the handle further comprises a third guiding line, wherein:

the securing tab extends from a side edge of the handle; and the third guiding line marks a folding point of the securing tab, wherein, as the securing tab is folded along the third guiding line and the handle is folded along the first guiding line, the securing tab holds the first side and the second side of the handle together.

7. The apparatus of claim 5, wherein:

the handle further comprises a slot that opposes the securing tab; and as the securing tab is positioned in the slot, the securing tab holds the first side and the second side of the handle together in a folded position of the handle.

8. The apparatus of claim 1, the handle further comprising a third guiding line, wherein:

the third guiding line is on an opposite face of the handle from the first guiding line and the second guiding line;

the third guiding line is approximately perpendicular to the first guiding line;

the third guiding line is approximate to the end of the handle opposite the scoop; and folding the handle along the third guiding line as the handle is also folded along the first guiding line holds the first side and the second side of the handle together.

9. The apparatus of claim 1, the handle further comprising a third guiding line, wherein:

the third guiding line is on a same face of the handle as the first guiding line;

the first side of the handle has a greater width than the second side of the handle;

the third guiding line is on the first side of the handle;

the third guiding line is spaced from the first guiding line by an amount approximately equal to a width of the second side of the handle; and folding the handle along the third guiding line over the second side of the handle as the handle is also folded along the first guiding line holds the first side and the second side of the handle together.

10. An apparatus, comprising:

a sheet of plastic, metallic, or plastic and metallic material, comprising:

a first planar section formed approximately in a shape of a functional end of an eating utensil; and a second planar section formed approximately in a shape of a handle of the eating utensil, wherein the second planar section is continuous with the first planar section;

a first guiding line, wherein:

the first guiding line extends along a length of the second planar section away from the first planar section;

the first guiding line extends towards an end of the second planar section opposite the first planar section; and the first guiding line divides the second planar section into a first side and a second side; and a second guiding line extending away from an intersection of the first planar section with the second planar section, wherein:

the first guiding line defines a first fold of the second planar section that brings the first side and the second side of the second planar section together;

as the first side and the second side of the second planar section are brought together and the second planar section is folded along the first guiding line, the first planar section forms an arch shape;

the second guiding line defines a second fold of the second planar section; and as the first side and the second side of the second planar section are brought together, the second planar section is folded along the first guiding line, and as the second planar section is further folded along the second guiding line, the first planar section forms a concave shape.

11. The apparatus of claim 10, wherein the sheet forms a lid for a container.

12. The apparatus of claim 10, wherein:

the sheet comprises an approximately uniform thickness; or the sheet comprises an approximately uniform thickness except along the first guiding line or the second guiding line.

13. The apparatus of claim 10, wherein, as the second planar section is folded along the first guiding line, the second planar section is approximately orthogonal to the first planar section.

14. The apparatus of claim 10, further comprising a tab extending from the second planar section, wherein the tab folds to join the first side and the second side of the second planar section as the second planar section is folded along the first guiding line.

15. An apparatus, comprising:

a container comprising a mouth defined by a rim; and a lid attached to the rim and covering the mouth of the container, wherein:

the lid is configured to be shaped into an eating utensil;

the lid is made of a sheet of material; and the lid comprises:

a functional end of the eating utensil defined by:

an outer edge of the lid; or a tear strip formed in the lid, wherein the tear strip is configured to be torn from between the lid and the functional end of the eating utensil to release the functional end of the eating utensil from the lid; and a handle that extends from the functional end of the eating utensil, wherein:

the handle is folded against the functional end of the eating utensil while the lid is attached to the rim of the container.

16. The apparatus of claim 15, further comprising a foil sheet attached to the rim of the container and covering the mouth of the container, wherein the foil sheet is positioned between the lid and the container.

17. The apparatus of claim 15, wherein the tear strip comprises:

a first trace and a second trace, wherein the first trace and the second trace have a thickness that is less than a thickness of the lid; and a pullstring between the first trace and the second trace, wherein the first trace, the second trace, and the pullstring are made of a same material as the lid.

18. The apparatus of claim 15, further comprising a set of guiding lines extending from an intersection of the functional end and the handle to a side edge of the handle, wherein:

folding the handle along a first guiding line of the set of guiding lines gives the functional end a first concavity; and folding the handle along a second guiding line of the set of guiding lines gives the functional end a second concavity that is different from the first concavity.

* * * * *